US006043722A

United States Patent [19]

Vaninetti et al.

[11] Patent Number: 6,043,722

[45] Date of Patent: Mar. 28, 2000

[54] MICROSTRIP PHASE SHIFTER INCLUDING A POWER DIVIDER AND A COUPLED LINE FILTER

[75] Inventors: Roy Vaninetti, Palm Bay; Gregory Marquardt, West Melbourne; Christopher Gregorean, Palm Bay, all of Fla.

[73] Assignee: Harris Corporation, Palm Bay, Fla.

[21] Appl. No.: 09/057,672

[22] Filed: Apr. 9, 1998

[51] Int. Cl.[7] ..... H01P 1/18; H01P 5/02

[52] U.S. Cl. ..... 333/128; 333/161

[58] Field of Search ..... 333/161, 156, 333/117, 120, 128, 136

[56] References Cited

U.S. PATENT DOCUMENTS

| | | | |
|---|---|---|---|
| 3,295,138 | 12/1966 | Nelson | 333/164 X |
| 3,568,105 | 3/1971 | Felsenheid | 333/164 |
| 4,105,959 | 8/1978 | Stachejko | 333/164 |
| 4,160,220 | 7/1979 | Stachejko | 333/161 |
| 4,205,282 | 5/1980 | Gipprich | 333/161 |
| 4,218,664 | 8/1980 | Assal et al. | 333/156 |
| 4,652,883 | 3/1987 | Andricos | 342/372 |
| 4,725,792 | 2/1988 | Lampe, Jr. | 333/128 X |
| 4,978,933 | 12/1990 | Marconi | 333/117 |
| 5,451,905 | 9/1995 | Gamand et al. | 330/286 |
| 5,489,880 | 2/1996 | Swarup | 333/128 |
| 5,684,440 | 11/1997 | Yabuki et al. | 333/204 |
| 5,703,020 | 12/1997 | Das | 505/210 |

*Primary Examiner*—Benny T. Lee
*Attorney, Agent, or Firm*—Allen, Dyer, Doppelt, Milbrath & Gilchrist, P.A.

[57] ABSTRACT

A broad band phase shifter of the present invention can be used in a microstrip conductor and includes a power divider disposed along a microstrip conductor. The power divider has first and second outputs. A reference transmission line is disposed on the microstrip conductor and connected to the first output of the power divider. A phase shift filter device is disposed on the microstrip conductor and connected to the second output of the power divider. The phase shift filter device comprises a 180 degree phase shift coupled line structure formed of a first substantially linear 90 degree phase shift parallel line section, and a second substantially linear 90 degree phase shift parallel line section coupled to the first parallel line section. The first and second 90 degree phase shift parallel line sections have parallel lines that are spaced about five mils apart. The first and second 90 degree phase shift parallel line sections also have parallel lines that are offset to each other.

21 Claims, 9 Drawing Sheets

MICROSTRIP PHASE SHIFTER INCLUDING A POWER DIVIDER AND A COUPLED LINE FILTER

FIELD OF THE INVENTION

This patent application relates to the field of phase shifters, and more particularly, to phase shifters that are used in a microstrip conductor.

BACKGROUND OF THE INVENTION

In a phased array antenna system, the overall antenna system includes a plurality of different antenna elements that are individually steered to direct and/or receive a beam in a selected direction. By using a phased array antenna system, it is possible to reduce the side lobes and, thus, minimize any power that is wasted in the antenna system.

With this type of system, the antenna beam is steered by adjusting the relative phase shift of each antenna element through individual phase shifters that are connected to each antenna element. The arrays are also typically sensitive to frequency. To overcome any sensitivity to frequencies, the phased array antenna system typically will use time delay steering where the signals propagated in each antenna element are time delayed to create a time coherence, and thus, steer the antenna beam into the predetermined direction.

Some prior art phased array antenna systems use a switched line phase shifter having more phase at higher frequencies than at lower frequencies. These type of phased array antenna systems require more bits of phase shift to achieve the same amount of phase at low and high frequencies. This also creates a limit to the amount of beam forming that can be accomplished at any one frequency for a given bandwidth. Other prior art switched delay line phase shifters are designed for different subbands, but require complex, expensive and large switching networks or diplexers. Others are complex and heavy, some even using lumped elements, requiring broad band attenuators that are expensive and have a great signal loss, thus mandating increased gain requirements. Even others have used 0 to 180 degree hybrids, but only for narrow band applications.

One type of phased array antenna system uses time delay steering having a binary controlled and switched delay line. This system uses appropriately delayed signals in each antenna element channel and is disclosed in U.S. Pat. No. 3,295,138 to Nelson. Each switched delay line comprises a plurality of fixed time delays, which are combined to produce successive increments of delay in response to binary control signals.

It is also desirable to use a microstrip circuit to reduce the cost of implementing a phased array antenna system. Microstrip is less expensive than other known prior art construction techniques. An example of a microstrip phase shifter is disclosed in U.S. Pat. No. 3,568,105 to Felsenheid. In the '105 patent, a reflective system is used, but does not disclose a switched line phase shifter with any time delay. The '138 patent, on the other hand, does disclose a switched line phase shifter that switches between two line lengths. However, the structure disclosed in the '138 patent works primarily on one frequency and has a more exact differential phase, and is thus limited to a narrow band area. It would be advantageous if a switched delayed line phased array could be used with a wideband system in a low cost microstrip.

It is believed that some prior art phased array antenna systems provide some phase shifting using filters as a phase shift element, and provide phase performance in the 100 MHZ to 300 MHZ frequency range with reduced size, such as possibly found on microstrip. This type of phase shifter can be used as a phase shifter in either a switched or series digital configurations, and contains individual filters with controlled phase shift values. Typically, the phase shifters are placed in tandem, with progressively greater phase shift angles to provide phase angle selectivity. However, it is desirable to form a structure that can be used with a wide range of frequencies, such as broad band in one or two GHz, and positioned on a microstrip conductor.

SUMMARY OF THE INVENTION

It is therefore an object of the present invention to provide a phase shifter used on a microstrip conductor that allows a broad band phase shift in the GHz range, which can be readily manufactured at little cost with relative simplicity.

It is still another object of the present invention to provide a phase shifter used on a microstrip conductor that can include several phase shift devices having progressively greater phase shift angles to provide phase angle selectivity in the GHz range.

The present invention is advantageous because it allows the construction of a phase shifter on a microstrip conductor and which accounts for broad band phase shift hybrid networks into a microstrip circuit without any complicated lumped element circuits. The phase shifter can also be combined to form a three-bit phase shifter that allows a beam to be moved around. The microstrip structure with the phase shift filter device of the present invention is also readily manufactured at low cost.

In accordance with the present invention, the phase shifter comprises a microstrip conductor. In one aspect of the present invention, a power divider is disposed along the microstrip conductor and has first and second outputs. A reference transmission line is disposed on the microstrip conductor and connected to the first output of the power divider. The phase shift filter device is disposed on the microstrip conductor and connected to the second output of the power divider. The phase shift filter device further comprises a 180 degree phase shift coupled line structure formed of a first substantially linear 90 degree phase shift parallel line section, and a second substantially linear 90 degree phase shift parallel line section coupled to the first parallel line section.

The first 90 degree phase shift parallel line section has parallel lines that are spaced about five mils apart. The second 90 degree phase shift parallel line section has parallel lines that are spaced about five mils apart. In still another aspect of the present invention, the first and second 90 degree phase shift parallel line sections have parallel lines that are offset to each other. The first and second 90 degree phase shift parallel line sections are substantially collinear to each other. The power divider further comprises a Wilkinson power divider. The microstrip conductor further comprises a monolithic microwave integrated circuit. The power divider further comprises a single line separated from the two opposing quarter wavelength sections. A referenced transmission line further comprises a substantially "U" shaped line structure positioned opposite to the phase shift filter device.

In a method aspect of the present invention, a phase shifter of the present invention can be formed by forming a microstrip conductor and forming a power divider on the microstrip conductor. The power divider is formed to have first and second outputs. A reference transmission line is formed on the microstrip conductor and connected to the first output of the power divider. A phase shift filter device is formed on the microstrip conductor and connected to the second output of the power divider. The method further comprises the step of forming a phase shift filter device on the microstrip conductor and connected to the second output of the power divider. The phase shift filter device is formed by forming a phase shift coupled line structure having a first substantially linear phase shift parallel line section, and a second substantially linear phase shift parallel line section coupled to the first parallel line section.

The method further comprises the step of forming each of the first and second phase shift parallel line sections as 90 degree phase shift parallel line sections. The method further comprises the step of forming the first and second 90 degree phase shift parallel line section with parallel lines that are spaced about five mils apart. The first and second parallel line sections are also formed to have parallel lines that are offset to each other. The microstrip conductor is also formed as a monolithic microwave integrated circuit.

In yet another embodiment of the present invention, the phase shifter comprises a microstrip conductor and a substantially "U" shaped reference transmission line formed on the microstrip conductor. The reference transmission line comprises a base line and two legs extending from the base line. A phase shift filter device is formed on the microstrip conductor adjacent the reference transmission line.

The phase shift filter device further includes a phased base transmission line positioned substantially parallel to the baseline and adjacent to two legs of the reference transmission line. A substantially "U" shaped phased transmission line is connected to the phased base transmission line and forms an open area bounded by the phased base transmission line and the "U" shaped phased transmission line. The "U" shaped phased transmission line has a width less than the reference transmission line. The phase shift device is preferably formed as a 90 degree phase shift device. The phase shifter further comprises a radial stub formed on the microstrip conductor within the open area bounded by the phased based transmission line and "U" shaped phased transmission line. The radial stub is connected to the "U" shaped phased transmission line to form an RF short.

In accordance with the present invention, a three-bit phase shifter includes a microstrip conductor and a 45 degree phase filter device formed on the microstrip conductor. The 45 degree phase shift filter device includes a 90 degree phase shift filter device formed from a substantially "U" shaped reference transmission line and a substantially "U" shaped phased transmission line having a radial stub for subtracting 45 degrees. The "U" shaped phased transmission line has a width less than the reference transmission line.

A 90 degree phase shift filter device is also formed on the microstrip structure and comprises a substantially "U" shaped reference transmission line and a substantially "U" shaped phased transmission line. The "U" shaped phased transmission line has a width less than the reference transmission line.

A 180 degree phase shift filter device is also formed on the microstrip structure and comprises a substantially "U" shaped reference transmission line and two substantially "U" shaped phase transmission lines, each forming a 90 degree phase shift filter device so that the two together form a 180 degree phase shift filter device. The "U" shaped phased transmission lines have a width less than the reference transmission line. An appropriate circuit selects the 45 degree, 90 degree and 180 degree phase shift filter devices for directing a beam in the desired direction.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout the different drawing figures and may not be described in detail for all figures.

Figure 1:
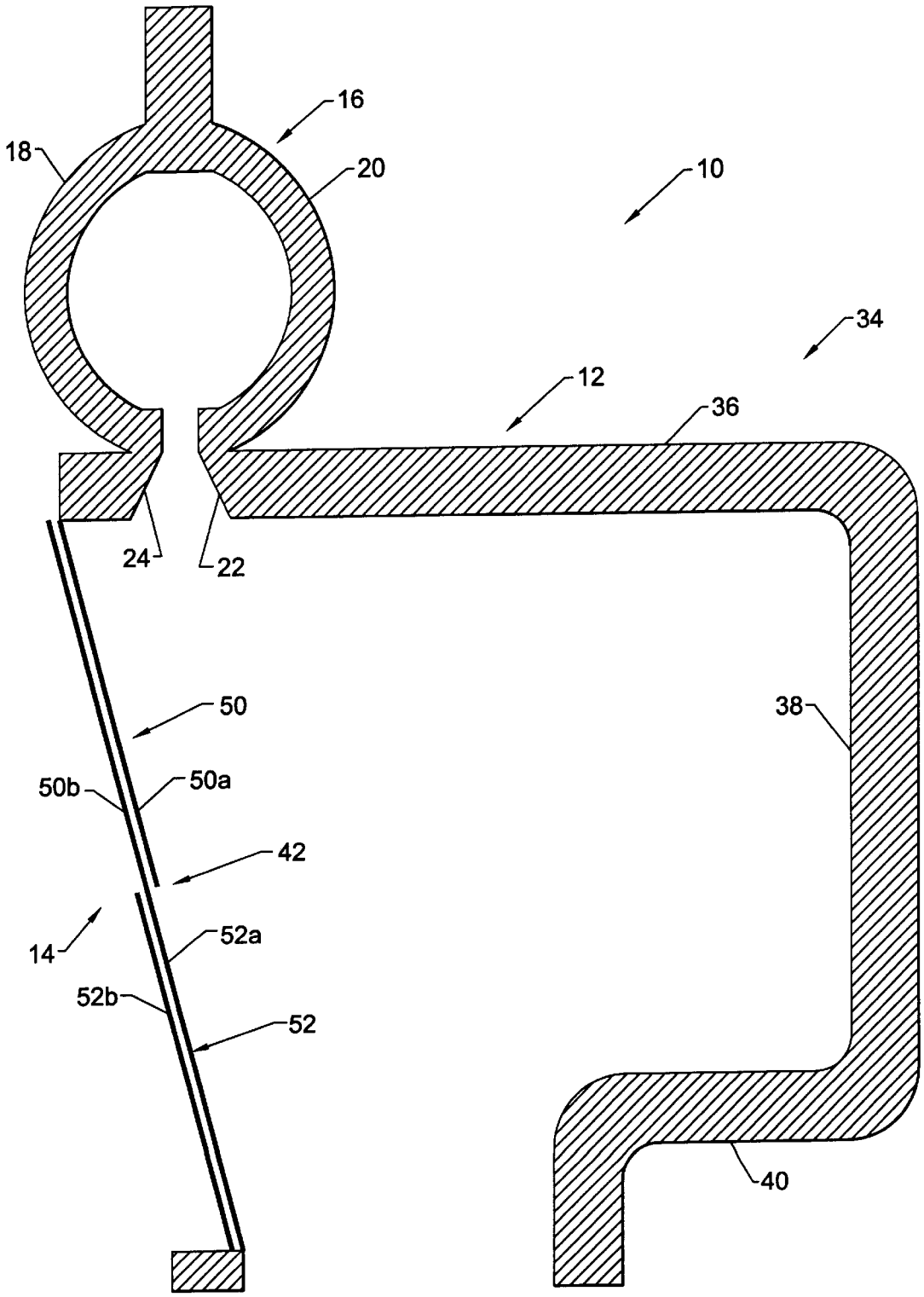
FIG. 1 shows a microstrip conductor formed as a 0/180 degree hybrid using a power divider and broad band phase shift device on one output of the power divider, and a reference transmission line functioning as a reference delay line connected to the other output of the power divider.

Referring now to FIG. 1, there is illustrated generally at 10 a phase shifter in accordance with the present invention that is included as part of a microstrip conductor 12 formed as a monolithic microwave integrated circuit. The microstrip conductor 12 can be formed by manufacturing techniques and materials known to those skilled in the art. Typically, the microstrip conductor, which could also be a strip line, is a transmission line formed typically on a monolithic microwave integrated circuit (MMIC). The microstrip conductor 12 functions similar to a distributed inductance in a microcircuit, but the transmission lines takes account of the associated capacitance, mutual coupling and discontinuities. Typically, the impedance of the microstrip circuit is determined by the ratio of a conductor width to any substrate thickness, dielectric constant of the substrate, and to a certain degree, the thickness of the conductor.

Figure 2:
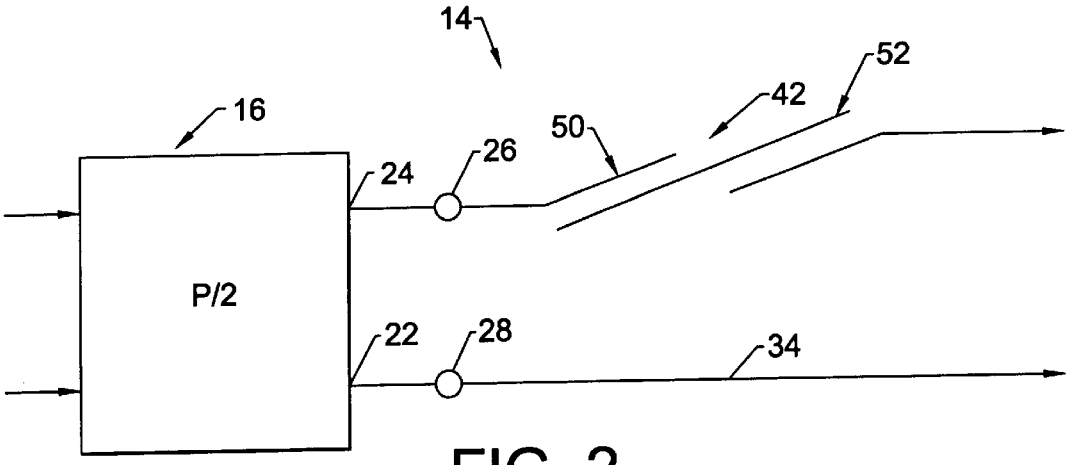
FIG. 2 is a schematic view of a coupled line section connected to a power divider to form a 0/180 degree hybrid.
Figure 3:
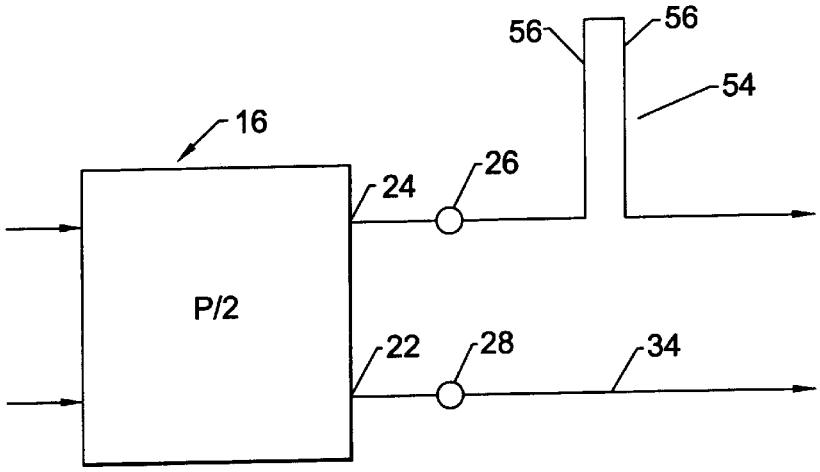
FIG. 3. (PRIOR ART)
FIG. 3 is a schematic view of a prior art Schiffman phase shift device connected to a power divider.

FIG. 1 illustrates a 0 to 180 degree hybrid formed as a coupled line structure 14 that allows a phase shift of 180 degrees as used in the present invention. FIG. 2 illustrates a schematic diagram of the coupled line structure 14 that is connected into a power divider (P/2) 16. The phase shifter 10 shown in FIG. 1 is advantageous over the older prior art Schiffman phase shifters (FIG. 3), which sometimes were inefficient and difficult to manufacture for various circuits.

As shown in FIG. 1, the microstrip conductor 12 includes a power divider 16, which in the illustrated embodiment is a Wilkinson power divider. The power divider comprises a single transmission power line separated into two opposing quarter wavelength sections 18,20 as known to those skilled in the art. First and second outputs 22,24 are positioned adjacent to each other to allow connection of an isolation resistor.

A reference transmission line 34 acts as a reference delay transmission line and is disposed on the microstrip conductor 12 and connected to the first output 22 of the power divider 16. The reference delay transmission line 34 forms a substantially "U" shaped transmission line having a first longer section or leg 36 that is connected to the first output 22 of the power divider 16, followed by a reference transmission line second section 38 that extends substantially perpendicular to the longer leg 36. It is then followed by a third shorter section or leg 40 extending in a similar direction of the first leg 36, but having a shorter length than the first leg 36. Appropriate connection points 26,28 are provided.

A phase shift filter device 42 of the present invention is disposed on the microstrip conductor 12 and is connected to the second output 24 of the power divider 16. The phase shift filter device 42 of the present invention comprises a 180 degree phase shift coupled line structure 14 formed of a first substantially linear 90 degree phase shift parallel line section 50, and a second substantially linear 90 degree phase shift parallel line section 52 coupled to the first parallel line section. The first and second 90 degree phase shift parallel line sections are substantially collinear to each other and extend at an angle from the second output of the power divider in a direction toward the reference transmission line 34.

Each of the first and second 90 degree phase shift parallel line sections 50,52 have first and second parallel lines 50*a*, 50*b*, 52*a*, 52*b*, respectively that are spaced apart about five mils, and as illustrated. The second parallel line 50*b* on the first 90 degree phase shift line section 50 is coupled to the first parallel line 52*a* of the second 90 degree phase shift line section 52. Each line 50*a*, 50*b*, 52*a*, 52*b* is substantially less in width than the reference line 34. In fact, even the total width of lines 50*a*, 50*b* or 52*a*, 52*b* plus the five mil gap is less than the width of reference line 38.

Figure 4:
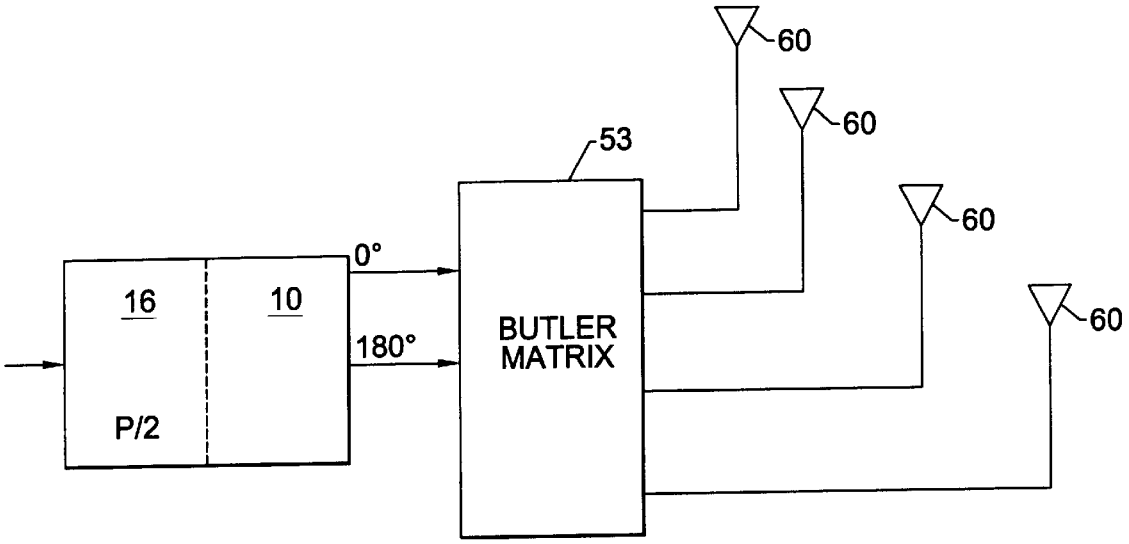
FIG. 4 is a schematic view of a phase shifter of the present invention connected to a Butler matrix for a multiple beam array.

The phase shifter of FIG. 1 is advantageous over other prior art phase shifters such as the prior art Schiffman phase shifter 54 (FIG. 3) using two parallel lines 56 connected to one output of a power divider 16. The phase shifter shown in FIG. 1 can be used to drive a Butler matrix 53 to form a multiple beam array for antenna 60, as shown in FIG. 4, where multiple networks can be used depending on system requirements. The present invention is advantageous because it allows the broad band phase shift while allowing beam directivity.

Figure 5:
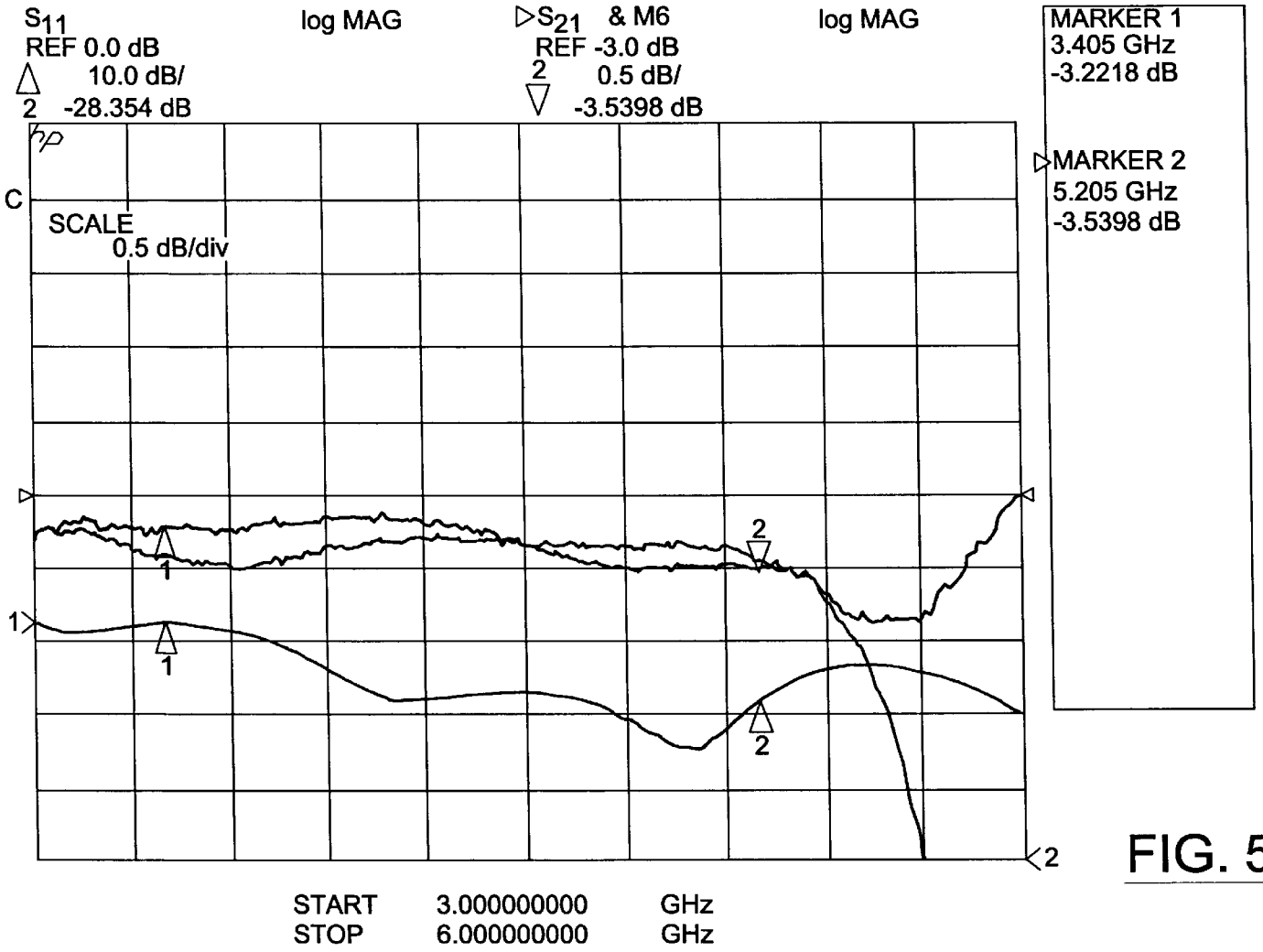
FIG. 5 is a graph showing measured data on the microstrip circuit shown in FIG. 1.
Figure 6:
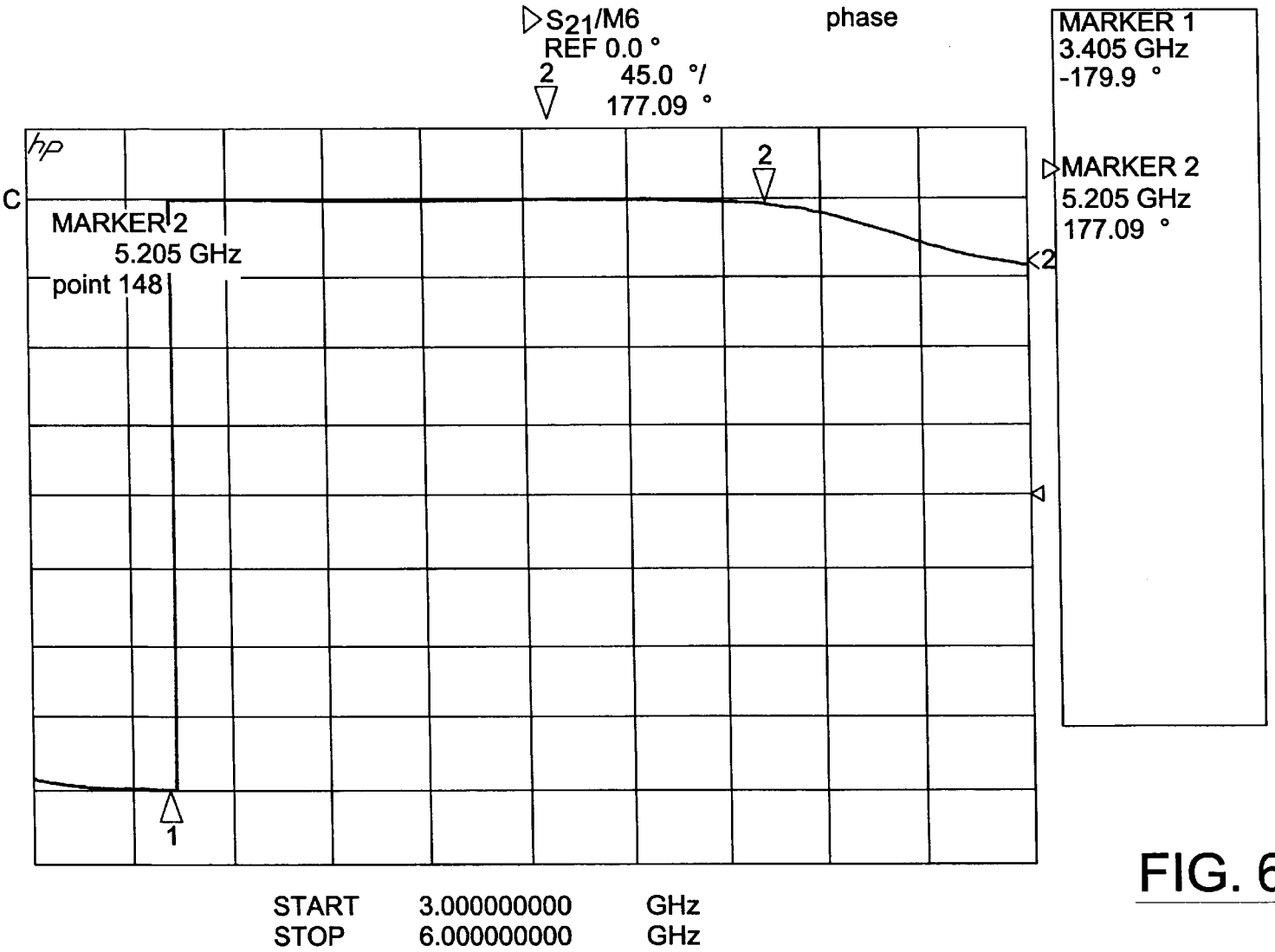
FIG. 6 is another graph showing measured data on the microstrip circuit shown in FIG. 1.

FIGS. 5 and 6 are graphs showing measured data on the microstrip conductor of FIG. 1. FIG. 5 shows three traces. The bottom trace is S(1,1), which is depicted on the upper left hand quadrant and effectively shows the return loss and how it is matched to the other two traces S(2,1) and what is stored in memory M6. S(2,1) and M6 are described in the other heading at the top of the graph and basically show the through path. Thus, FIG. 5 shows that the loss is virtually equally split between the two paths and illustrates the broad band nature of the invention. The left hand coordinates at 1,1 are 10 db per division and the S(2,1) are 0.5 db per division, thus giving more line changes. FIG. 6 shows the phase between the two through paths where the top description is S(2,1) divided by M6, corresponding to the other path of the power divider. When one divides them, it is effectively subtracting the phase of the through path and shows that there is a 180° phase. It is shown as 45° per division. It is evident that the circuits shown in FIG. 1 allow a broad band phase shift and achieves excellent amplitude and phase balance over 3.4 to 5.2 GHz band.

Figure 7:
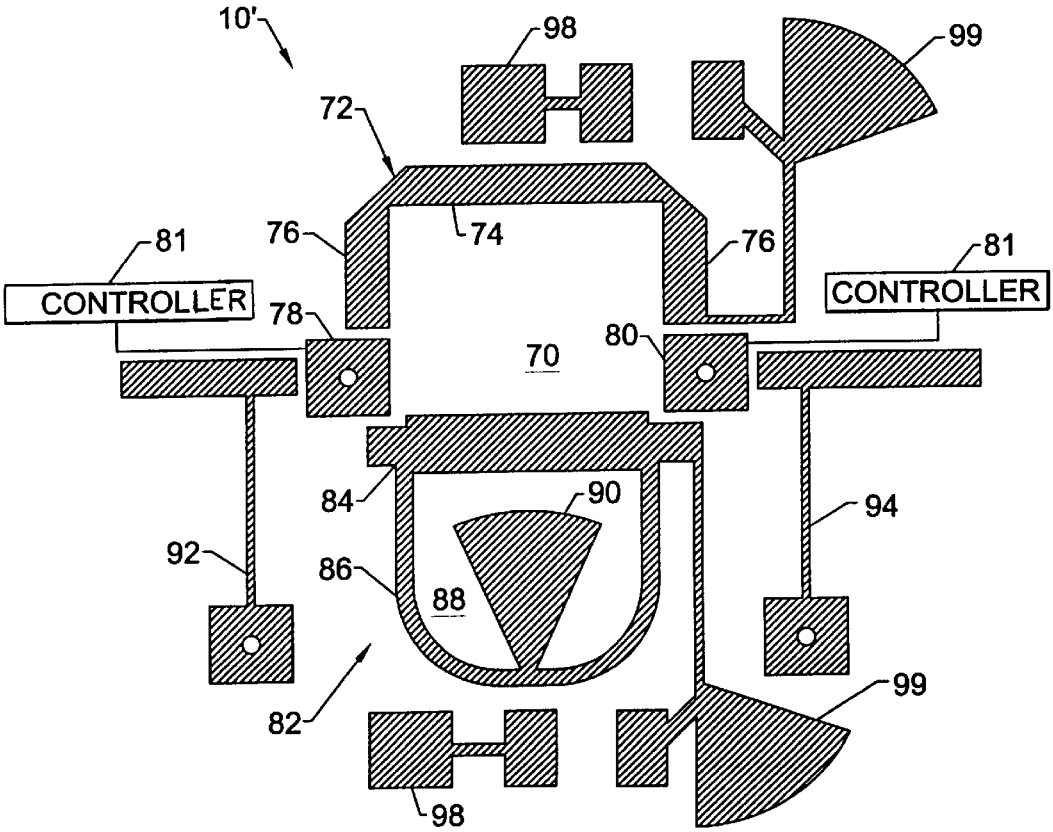
FIG. 7 is a schematic plan view of a microstrip circuit using a phase shifter having a reference transmission line and phase shift filter device formed as phased base transmission line and a substantially "U" shaped phased transmission line.

Referring now to FIG. 7, there is illustrated another embodiment of a phase shifter 10' in accordance with the present invention that allows a 90 degree phase shift. As illustrated, the phase shifter includes a microstrip conductor 70 having a substantially "U" shaped reference transmission line 72 formed on the microstrip conductor 70. Line 72 acts as a delay line. The reference transmission line 72 has a base line 74 with two legs 76 extending from the base line. Adjacent the two legs 76 and extending from the base line 74 are respective first and second switch points 78,80 and connect to controller 81.

A phase shift filter device 82 is formed on the microstrip conductor 12 adjacent the reference transmission line 72 and the first and second switch points 78,80. The phase shift filter device 82 comprises a phased base transmission line 84 positioned substantially parallel to the base line 74 and adjacent the two legs 76 of the reference transmission line 72.

A substantially "U" shaped phased transmission line 86 is connected to the phased base transmission line 84 and forms an open area 88 bounded by the phased base transmission line and the "U" shaped transmission line. The "U" shaped phased transmission line 86 has a width less than the reference transmission line 72. This difference in width helps establish the broad band capability of the device. As illustrated, a radial stub 90 is formed on the microstrip conductor 12 within the open area 88 bounded by the phased base transmission line 84 and the "U" shaped phased transmission line 86. The radial stub 90 is connected to the "U" shaped phased transmission line, which forms an RF short. The microstrip structure also includes biased circuits illustrated at 92 and 94. Other contact points 98 and circuit components 99 allow connection of the device to respective circuit connections. In operation, the first and second switch points 78,80 are respectively operated to allow the 90 degree phase shift that is advantageous for use in the present invention.

Figure 8:
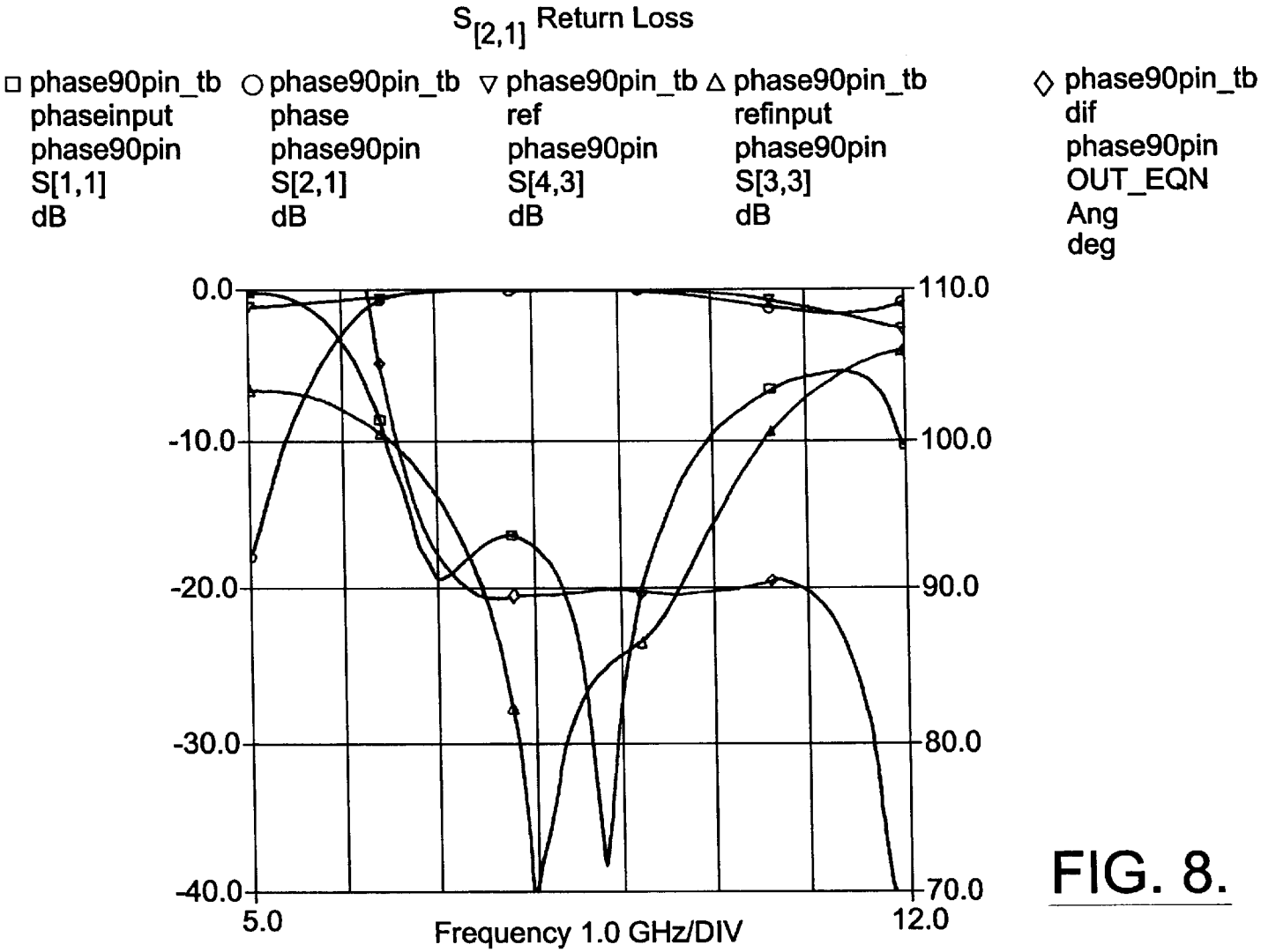
FIG. 8 is a graph showing the return loss and differential phase shift of the microstrip circuit of FIG. 7.

FIG. 8 is a graph illustrating a return loss, S21, and the differential phase shift of the phase shifter of FIG. 7. FIG. 8 describes the phase shifter, which is two switched paths and is a projected performance of the four traces (described by different squares, circles and triangles on the lines). S(1,1) is the return loss, i.e., how well matched it is, and S(2,1) is a through path. S(4,3) is the through path of the other part of the phase shifter with the flag set on the line. S(3,3) is the return loss of that path. The far right shows the output equation. S(2,1) of one path is divided by the S(2,1) of the other, which is depicted as S(4,3). That gives a differential phase shift between the two as shown for 90°. The right hand axis shows a scale between 7 GHz to 11 GHz to get a 90° phase shift. The differential phase shift is derived by dividing S21 of the network under test by the S21 of the reference network and plotting the angle of the result. A predicted performance shows a flat 90 degree phase shift for an almost 3 GHz of bandwidth at a 9 GHz center frequency.

Figure 9:
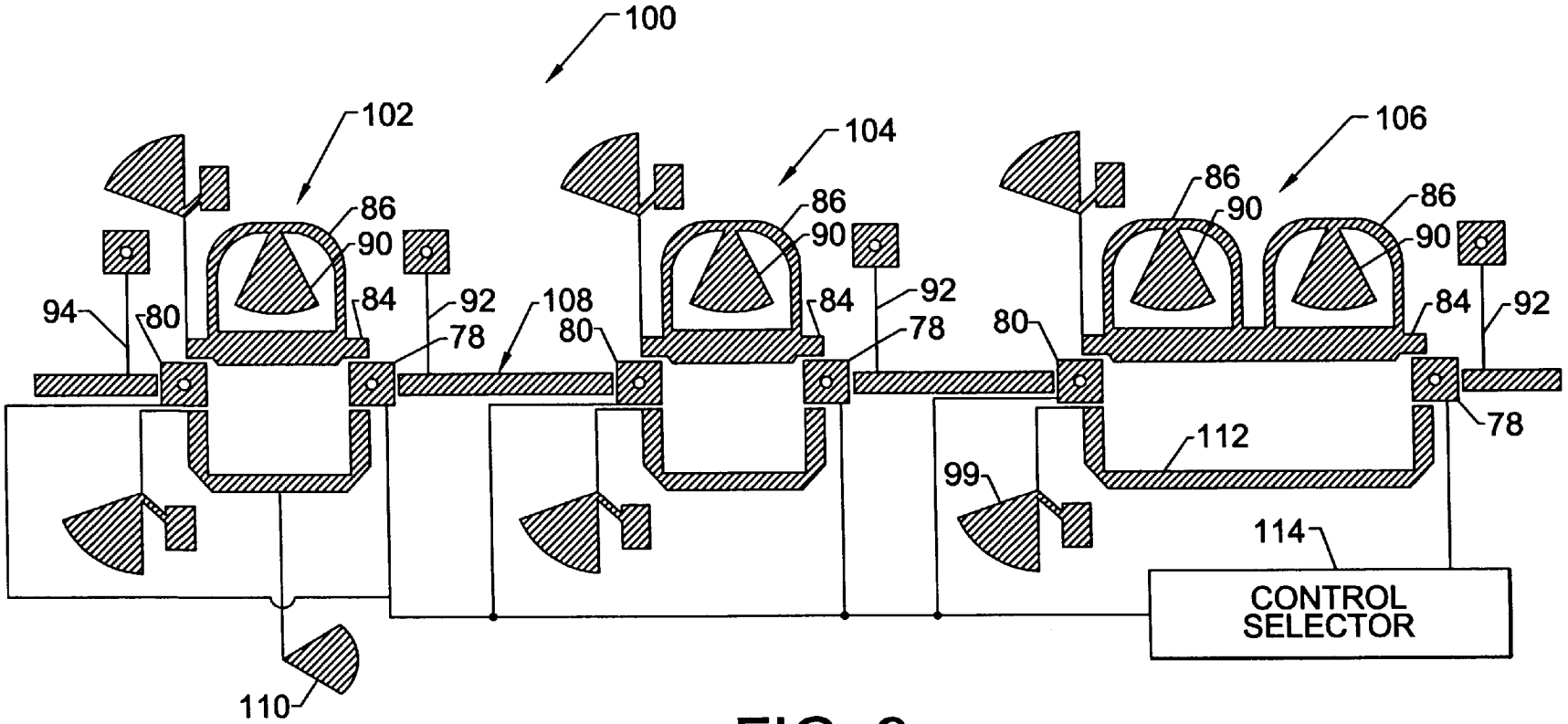
FIG. 9 is a microstrip circuit having a three-bit phase shifter of the present invention.

FIG. 9 shows a three-bit phase shifter 100 of the present invention that incorporates the basic structure of the phase shifter 10' shown in FIG. 7, but also includes a 45 degree phase shift filter device 102, a 90 degree phase shift filter device 104, and a 180 degree phase shift filter device 106. Unless otherwise noted, like reference numerals in FIG. 9 correspond to like elements as depicted in the circuit of FIG. 7 and may not be described in detail for FIG. 9. These devices are formed on a microstrip conduts 108 that connects devices 102, 104 and 106 along one conductive path. The 45 degree phase shift filter device 104 is formed similar to that shown in FIG. 7, except it includes a radial stub 110 that is positioned offset from the reference transmission line to subtract 45 degrees from the 90 degrees.

The 90 degree phase shift filter device 104 is formed similar to that shown in FIG. 7 with no radial stub offset from the reference transmission line.

Figure 10:
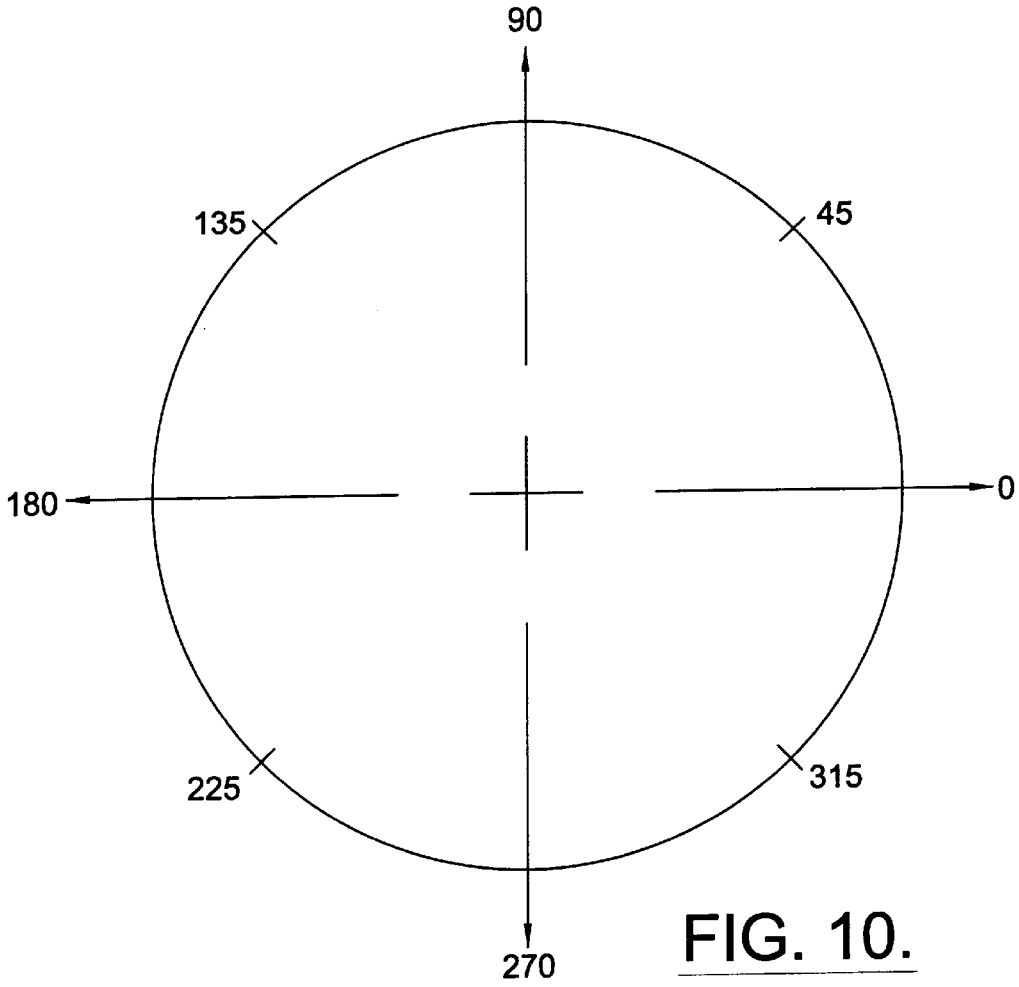
FIG. 10 is a graph illustrating the various beam angles that can be formed with the three-bit phase shifter illustrated in FIG. 9.

The 180 degree phase shift filter device comprises an enlarged substantially "U" shaped reference transmission line 112 and two substantially "U" shaped transmission lines 86 having a width less than the reference transmission line 112. Thus, the 180 degree phase shift filter device is basically the incorporation of two 90 degree phase shift filter devices as shown in FIG. 7. Each of the phase shift filter devices are selected by an appropriate control selector 114 to provide the desired beam angle as shown in FIG. 10.

For example, three bits are input to obtain a desired angle. The appropriate degree angle relative to the input bit value could be as follows:

100=45°

010=90°

110=135°

001=180°

101=235°

011=270°

111=315°

It is evident that the present invention now allows a phase shifter that can be incorporated on a microstrip conductor and allows not only for ease in manufacturing, but allows a very broad band phase balance over an extended GHz band and excellent amplitude. The 0 to 180 degree hybrid using the coupled line structure is inexpensive and can be readily manufactured by semiconductor and antenna transmission line techniques known to those skilled in the art.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. A phase shifter comprising:

a microstrip conductor;

a power divider disposed along said microstrip conductor, said power divider having first and second outputs;

a substantially "U" shaped reference transmission line disposed on said microstrip conductor and connected to said first output of said power divider; and a phase shift filter device disposed on said microstrip conductor and connected to said second output of said power divider, said phase shift filter device comprising a 180 degree phase shift coupled line structure having opposing ends with one end connected to said power divider, and comprised of a first substantially linear 90 degree phase shift parallel line section comprised of two parallel spaced apart lines and a second substantially linear 90 degree phase shift parallel line section comprised of two parallel spaced apart lines coupled to said first parallel line section at the other end of said respective first substantially linear 90 degree phase shift parallel line section opposite the end connected to the power divider, and spaced offset from the respective spaced lines of the first section such that only one line of each respective section is collinear to each other, wherein said respective two line sections are positioned opposite said "U" shaped reference transmission line.

2. A phase shifter according to claim 1, wherein said first 90 degree phase shift parallel line section has parallel lines that are spaced about 5 mils apart.

3. A phase shifter according to claim 1, wherein said second 90 degree phase shift parallel section has parallel lines that are spaced about 5 mils apart.

4. A phase shifter according to claim 1, wherein said microstrip conductor comprises a monolithic microwave integrated circuit.

5. A phase shifter according to claim 1, wherein said power divider comprises a single line separated into two opposing quarter wavelength sections.

6. A phase shifter according to claim 1, wherein said power divider comprises a Wilkinson power divider.

7. A phase shifter comprising:

a microstrip conductor;

a substantially "U" shaped reference transmission line disposed on said microstrip conductor; and a phase shift filter device disposed on said microstrip conductor and operatively connected to said reference transmission line, said phase shift filter device comprising a phase shift coupled line structure and comprised of a first substantially linear 90 degree phase shift having opposing ends parallel line section comprised of two parallel spaced apart lines and a second substantially linear 90 degree phase shift parallel line section coupled to said first parallel line section at the other end of said first substantially linear 90 degree phase shift parallel line section opposite the end connected to the power divider, and comprised of two parallel spaced apart lines that are spaced offset from the respective spaced lines of the first section such that only one line of each respective section is collinear to each other, wherein said respective two line sections are positioned opposite said "U" shaped reference transmission line.

8. A phase shifter according to claim 7, wherein said first 90 degree phase shift parallel line section has parallel lines that are spaced about 5 mils apart.

9. A phase shifter according to claim 7, wherein said second 90 degree phase shift parallel section has parallel lines that are spaced about 5 mils apart.

10. A phase shifter according to claim 7, wherein said microstrip conductor comprises a monolithic microwave integrated circuit.

11. A phase shifter comprising:

a microstrip conductor;

a Wilkinson power divider disposed along said microstrip conductor, said power divider comprising a single line separated into two opposing quarter length sections and having first and second outputs positioned substantially adjacent to each other;

a reference transmission line disposed on said microstrip conductor and connected to said first output of said power divider, said reference transmission line comprising a substantially "U" shaped transmission line having two legs, wherein one leg is connected to said first output of said power divider; and a phase shift filter device disposed on said microstrip conductor and connected to said second output of said Wilkinson power divider, said phase shift filter device comprising a 180 degree phase shift coupled line structure having opposing ends with one end connected to said power divider, and comprised of a first substantially linear 90 degree phase shift parallel line section comprised of two parallel spaced apart lines and a second substantially linear 90 degree phase shift parallel line section comprised of two parallel spaced apart lines coupled to said first parallel line section at the other end of said first substantially linear 90 degree phase shift parallel line section opposite the end connected to the power divider, and spaced offset from the respective spaced lines of the first section such that only one line of each respective section is collinear to each other, wherein said two respective line sections are positioned opposite said "U" shaped reference transmission line.

12. A phase shifter according to claim 11, wherein said second 90 degree phase shift parallel section has parallel lines that are spaced about 5 mils apart.

13. A phase shifter according to claim 11, wherein said first 90 degree phase shift parallel line section has parallel lines that are spaced about 5 mils apart.

14. A phase shifter according to claim 11, wherein said Wilkinson power divider comprises a monolithic microwave integrated circuit.

15. A phase shifter according to claim 11, wherein said Wilkinson power divider comprises a single line separated into two opposing quarter wavelength sections.

16. A method of forming a phase shifter comprising the steps of:

forming a microstrip conductor;

forming a power divider on the microstrip conductor, wherein the power divider has first and second outputs;

forming a substantially "U" shaped reference transmission line on the microstrip conductor and connecting the reference transmission line to the first output of the power divider; and forming a phase shift filter device on the microstrip conductor and connecting the phase shift filter device to the second output of the power divider, wherein the phase shift filter device comprises a phase shift coupled line structure having opposing ends with one end connected to the power divider and formed of a first substantially linear 90 degree phase shift parallel line section comprised of two parallel spaced apart lines and a second substantially linear phase shift parallel line section coupled to the first parallel line section at the other end of said respective first substantially linear 90 degree phase shift parallel line section opposite the end connected to the power divider, and comprised of two parallel spaced apart lines that are spaced offset from the spaced apart lines of the first section such that only one line of each section is collinear relative to each other, wherein said two line sections are positioned opposite said "U" shaped reference transmission line.

17. A method according to claim 16, and further comprising the step of forming the second 90 degree phase shift parallel section with parallel lines that are spaced about 5 mils apart.

18. A method according to claim 16, and further comprising the step of forming the microstrip conductor as a monolithic microwave integrated circuit.

19. A method according to claim 16, and further comprising the step of forming the power divider as a single line and separating the single line into two opposing quarter wavelength sections.

20. A method according to claim 16, and further comprising the step of forming the power divider as a Wilkinson power divider.

21. A method according to claim 16, and further comprising the step of forming the first 90 degree phase shift parallel line section with parallel lines that are spaced about 5 mils apart.

* * * * *

UNITED STATES PATENT AND TRADEMARK OFFICE

CERTIFICATE OF CORRECTION

PATENT NO. : 6,043,722
DATED : March 28, 2000
INVENTOR(S) : Vaninetti et al.

It is certified that error appears in the above-identified patent and that said Letters Patent is hereby corrected as shown below:

Item [56] References Cited, insert:

OTHER ART

-- KDI/Triangle Model MIC-D43S, Digital 8-Phase Shifter For 100 MHz to 300 Mhz (trade advertisement). --.

Signed and Sealed this

Twenty-fifth Day of December, 2001

*Attest:*

*Attesting Officer*

JAMES E. ROGAN
*Director of the United States Patent and Trademark Office*